United States Patent [19]

Schlottke et al.

[11] Patent Number: 4,854,932

[45] Date of Patent: Aug. 8, 1989

[54] METHOD OF AND APPARATUS FOR GATHERING AND MANIPULATING STACKED ZIG-ZAG FORMATIONS OF PAPER SHEETS

[75] Inventors: Karl-Heinz Schlottke, Tangstedt; Jürgen Peter, Hamburg, both of Fed. Rep. of Germany

[73] Assignee: E.C.H. Will GmbH, Hamburg, Fed. Rep. of Germany

[21] Appl. No.: 110,289

[22] Filed: Oct. 19, 1987

[30] Foreign Application Priority Data

Oct. 22, 1986 [DE] Fed. Rep. of Germany ..... 3635895

[51] Int. Cl.[4] ..... B05B 1/14

[52] U.S. Cl. ..... 493/357; 493/369

[58] Field of Search ..... 493/357, 369; 414/115, 414/908; 198/422

[56] References Cited

U.S. PATENT DOCUMENTS

| | | | |
|---|---|---|---|
| 2,675,747 | 4/1954 | Greiner . | |
| 3,301,111 | 1/1967 | Nystrand . | |
| 4,205,836 | 6/1980 | Nystrand | 270/73 |
| 4,297,066 | 10/1981 | Ramcke et al. | 414/43 |
| 4,406,650 | 9/1983 | Felix | 493/410 |
| 4,507,109 | 3/1985 | Meschi | 493/356 |
| 4,508,527 | 4/1985 | Uno et al. | 493/357 |
| 4,618,340 | 10/1986 | Meschi | 493/13 |

FOREIGN PATENT DOCUMENTS

| | | | |
|---|---|---|---|
| 2264633 | 7/1974 | Fed. Rep. of Germany . | |
| 2073716 | 10/1981 | United Kingdom | 493/357 |

*Primary Examiner*—Eugene R. LaRoche
*Assistant Examiner*—Robert J. Pascal
*Attorney, Agent, or Firm*—Peter K. Kontler

[57] ABSTRACT

A continuous running paper web is folded in zig-zag formation at a stacking station to form a pile of superimposed panels which are joined to each other by weakened fold lines. A stack containing a preselected number of superimposed panels at the bottom of the pile is moved laterally away from the stacking station so that the topmost panel of the stack or the lowermost panel of the remainder of the pile is unfolded, and the web is broken between such panels by tearing it along a weakened fold line or by severing it from one marginal portion to the other marginal portion along a weakened fold line or across one of the panels. The part or parts which move the stack from the stacking station can include or constitute the web breaking device. The remainder of the pile is supported from below during removal of the stack from the stacking station.

30 Claims, 5 Drawing Sheets

METHOD OF AND APPARATUS FOR GATHERING AND MANIPULATING STACKED ZIG-ZAG FORMATIONS OF PAPER SHEETS

BACKGROUND OF THE INVENTION

The present invention relates to a method of and to an apparatus for manipulating a running web or strip of paper, metallic or plastic foil or other elongated strip-shaped foldable material. More particularly, the invention relates to improvements in methods of and in apparatus for gathering and manipulating stacked zig-zag formations of sheets or panels which are made of paper and/or a metallic or plastic material.

It is known to stack successive sections or panels of a continuous running web in zig-zag formations wherein the neighboring panels overlie each other and are joined along fold lines which can be weakened, e.g., by rows of perforations, by pronounced scoring and/or in any other suitable way. It is necessary to separate successive accumulations or stacks of overlapping panels from the web, e.g., for introduction of separated stacks into boxes, cartons or other types of receptacles. Separation of successive fully grown stacks from the running web presents numerous problems, either because it necessitates an interruption of the zig-zag folding operation or because the breaking of the web is unpredictable and cannot always be carried out at a predetermined location (e.g., along a selected fold line) so that the rearmost panel of a fully grown stack and/or the foremost panel of the next-following (growing) stack is damaged or destroyed. Moreover, heretofore known mechanisms for separating successive fully grown stacks from the web which is being converted into a pile of superimposed or overlapping panels in zig-zag formation are complex, bulky and expensive.

OBJECTS AND SUMMARY OF THE INVENTION

An object of the invention is to provide a novel and improved method which renders it possible to separate successive fully grown stacks of zig-zag formations of superimposed panels or sheets from a continuous web of paper or the like in a predictable manner and without any damage to the panels in the region of the break.

Another object of the invention is to provide a method which renders it possible to break or tear the web at desired intervals without actually cutting into the material of the web.

A further object of the invention is to provide a method which renders it possible to invariably separate from the running continuous web successive fully grown stacks each of which contains the same number, or a desired number, of panels or sheets.

An additional object of the invention is to provide a method which can be practiced while the leader of the running web is being converted into a succession of panels in zig-zag formation at an elevated speed and without necessitating even partial deceleration of the web.

Still another object of the invention is to provide a method which renders it possible to salvage the panel or panels in the region of the break in the web.

A further object of the invention is to provide a novel and improved apparatus for the practice of the above outlined method and to construct and assemble the apparatus in such a way that it can break the web at a selected location while the leader of the web is being converted into a pile of panels in zig-zag formation and while the web is advanced at the normal operating speed.

Another object of the invention is to provide the apparatus with novel and improved means for breaking the web.

An additional object of the invention is to provide the apparatus with novel and improved means for manipulating fully grown stacks and growing stacks of zig-zag formations of panels prior, during and subsequent to the making of a break in the web.

One feature of the present invention resides in the provision of a method of separating a fully grown first stack of overlapping or superimposed panels or sheets which are folded over each other in zig-zag formation from a growing second stack which is being formed by zig-zag folding a continuous web of paper or a like foldable material and has a foremost panel which is integral with a rearmost panel of the first stack. The method comprises the step of breaking the web in the region of one of the foremost and rearmost panels or sheets.

The method can further comprise the steps of advancing the web longitudinally in a predetermined direction to a stacking station wherein the second stack is located at a level above the first stack so that the foremost panel is the lowermost panel of the second stack and the rearmost panel is the topmost panel of the first stack, and removing the first stack from the stacking station in the course of or prior to the breaking step. The removing step can include unfolding the rearmost panel of the first stack and/or the foremost panel of the second stack.

The breaking step can include changing the orientation of one of the stacks relative to the other stack with attendant tearing of the web from one toward the other marginal portion of the web. Such orientation changing step can include turning the first stack about a substantially vertical axis so as to increase the tensional stress within the web beyond the breaking or tearing point.

The second stack can be formed by zig-zag folding a continuous longitudinally running web of paper or a like foldable material which has transversely extending weakened portions serving to join neighboring panels of the stacks to each other. The breaking step can include destroying the integrity of the web along one of such weakened portions. Alternatively, the breaking step can include severing or tearing the web.

The method can further comprise the step of destroying the integrity of at least one marginal portion of the running web in the aforementioned region prior to the breaking step so as to facilitate breaking of the web material. Such destroying step can include making a cut in the one marginal portion of the web or tearing the one marginal portion of the web in the aforementioned region where the web is to be broken so as to separate the first stack from the second stack.

The breaking step can include unfolding the foremost panel of the second stack and separating the unfolded foremost panel from the rearmost panel of the first stack, and such method can further comprise the step of refolding the foremost panel of the second stack over the next-following panel of such stack. Alternatively, the breaking step can include unfolding the rearmost panel of the first stack and separating the unfolded rearmost panel from the foremost panel of the second stack, and such method then preferably further comprises the step of refolding the rearmost panel of the first stack over the preceding panel of such stack.

Another feature of the invention resides in the provision of an apparatus for separating a fully grown first stack of overlapping or superimposed panels of sheets which are folded over each other in zig-zag formation at a stacking station from a growing second stack which is being formed at the stacking station by zig-zag folding a continuous longitudinally advancing web of paper or a like foldable material and has a foremost panel which is integral with a rearmost panel of the first stack. The apparatus comprises means for breaking the web in the region of one of the rearmost and foremost panels. The apparatus can further comprise means for locating the first stack at the stacking station beneath the second stack so that the foremost panel of the second stack is located above the rearmost panel of the first stack, and means for supporting the second stack at the second station including a supporting member (such as a hook or a table) and means for moving the supporting member between the foremost panel of the second stack and the rearmost panel of the first stack at the stacking station. Such apparatus can further comprise means for evacuating the first stack from the stacking station prior to breaking of the web between the first and second stacks. The evacuating means can include means for unfolding the rearmost panel of the first stack and/or the foremost panel of the second stack during evacuation of the first stack from the stacking station. Such evacuating means can include means for transporting the first stack from the stacking station along a predetermined path, and the breaking means of such apparatus can be placed adjacent the predetermined path so as to break the web in the region of the unfolded rearmost panel of the first stack or in the region of the unfolded foremost panel of the second stack.

The evacuating means can comprise at least one tongs (such as tongs with a pair of jaws) which are engageable with the first stack in the regions of the foremost and rearmost panels of the first stack, and means for moving the tongs substantially in and counter to the direction of advancement of the web which is being converted into panels of the stacks. The evacuating means which includes such tongs can embody the breaking means. For example, the evacuating means can be designed to turn one of the stacks relative to the other stack so as to increase the tensional stress within the web beyond the breaking point.

As mentioned above, the breaking means can include evacuating means (or vice versa) having means for moving the first stack away from stacking station in a direction to unfold at least one of the foremost and rearmost panels (namely the foremost panel of the second stack and/or the rearmost panel of the first stack) and for moving the first stack through a distance which exceeds the length of the unfolded panel or panels (as considered in the longitudinal direction of the web) so that the web is compelled to break in the region of the unfolded panel or panels.

The breaking means can include means for changing the orientation of one of the stacks (especially of the first stack) relative to the other stack so that the web tears in the aforementioned region in a direction from one marginal portion toward the other marginal portion of the web as a result of the development of excessive internal tensional stresses in the one marginal portion of the web. At such time, the means for supporting the second stack at the stacking station at a level above the first stack holds the second stack against a change of orientation while the orientation of the first stack is being changed with resultant tearing of the web from one to the other marginal portion of the web.

The foremost panel of the first stack is normally the lowermost panel of such stack, and the evacuating means can comprise means for moving the first stack away from the stacking station along the aforementioned predetermined path so as to unfold at least one of the foremost and rearmost panels, namely the foremost panel of the second stack and/or the rearmost panel of the first stack). The moving means of such evacuating means can include a pair of tongs having portions (for example in the form of jaws) which are engageable with the first stack in the regions of the foremost and rearmost panels of the first stack, and means for moving such tongs along the predetermined path. The orientation changing means of such apparatus can comprise means for changing the speed of movement of one of the tongs relative to the other of the tongs to thereby turn the first stack relative to the second stack. For example, the means for changing the speed of movement of one of the tongs can include an impediment or hindrance which is placed into the path of movement of the one tongs so that such one tongs are actually brought to a full stop or are decelerated to a speed less than the speed of the other tongs with resultant turning of the first stack, preferably about a substantially vertical axis. If the web is to be broken in a manner other than by turning the first stack relative to the second stack, the evacuating means can comprise single tongs which advance the first stack along the predetermined path and the web is then severed in a different way, for example, by outright cutting across from one to the other marginal portion of the web or by destroying a weakened portion which joins two neighboring panels to each other.

As mentioned above, the apparatus can comprise means for supporting the second stack during breaking of the web between the first and second stacks. Such supporting means can be located at or close to the stacking station and can comprise a first and a second supporting member as well as means for moving such supporting members into and from the stacking station so that one of the foremost and rearmost panels (namely the foremost panel of the second stack or the rearmost panel of the first stack) is held between the supporting members during breaking of the web between the first and second stacks. One of the supporting members can include a table and the supporting means which includes such table further comprises means for moving the table to and from the stacking station so that the table is located beneath the foremost or lowermost panel of the second stack while at the stacking station. The other member of such supporting means can comprise a substantially hook-shaped element having a tooth or pallet, and the supporting means which includes such hook-shaped supporting element can include means for moving the pallet up and down toward and away from the table so that the foremost panel of the second stack is held between the table and the pallet when the latter is adjacent the table.

The apparatus can further comprise means for destroying the integrity of at least one marginal portion of the web in a predetermined portion of the path of movement of the first stack away from the stacking station preparatory to breaking of the web so that the integrity of the web is destroyed in a direction from the one marginal portion toward the other marginal portion of the web. This facilitates subsequent total breaking of the web all the way from the one to the other marginal portion.

As mentioned above, the evacuating means for the first stack can include means for unfolding the rearmost panel of the first stack prior to breaking of the web in the aforementioned region, and such apparatus preferably further comprises means (such as one or more nozzles which discharge one or more jets of compressed air or another gaseous fluid and/or a suitably configurated guide rail) for refolding the rearmost panel of the first stack upon completed breaking of the web so that the refolded rearmost panel overlies the preceding panel of the first stack. Alternatively, the evacuating means for the first stack can include means for unfolding the foremost panel of the second stack prior to breaking of the web in the aforementioned region, and such apparatus preferably further comprises means for refolding the foremost panel of the second stack upon completed breaking of the web so that the refolded foremost panel overlies the next-following panel of the second stack. The refolding means can form part of the evacuating means. For example, the aforementioned tongs can be designed to refold the foremost (lowermost) panel of the second stack during movement toward and into the stacking station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
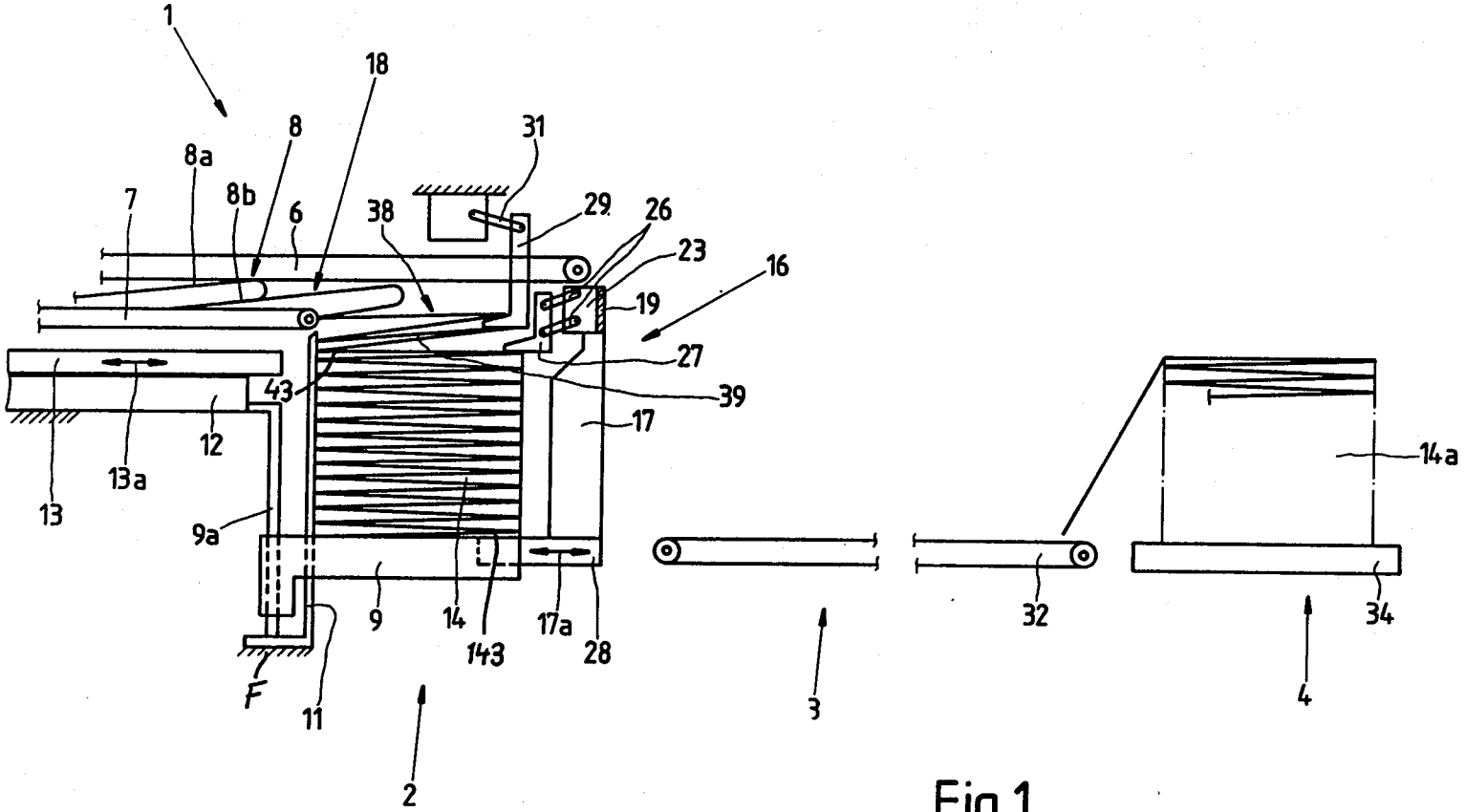
FIG. 1 is a schematic elevational view of an apparatus which embodies one form of the invention, a freshly formed stack being shown at the stack forming station.
Figure 2:
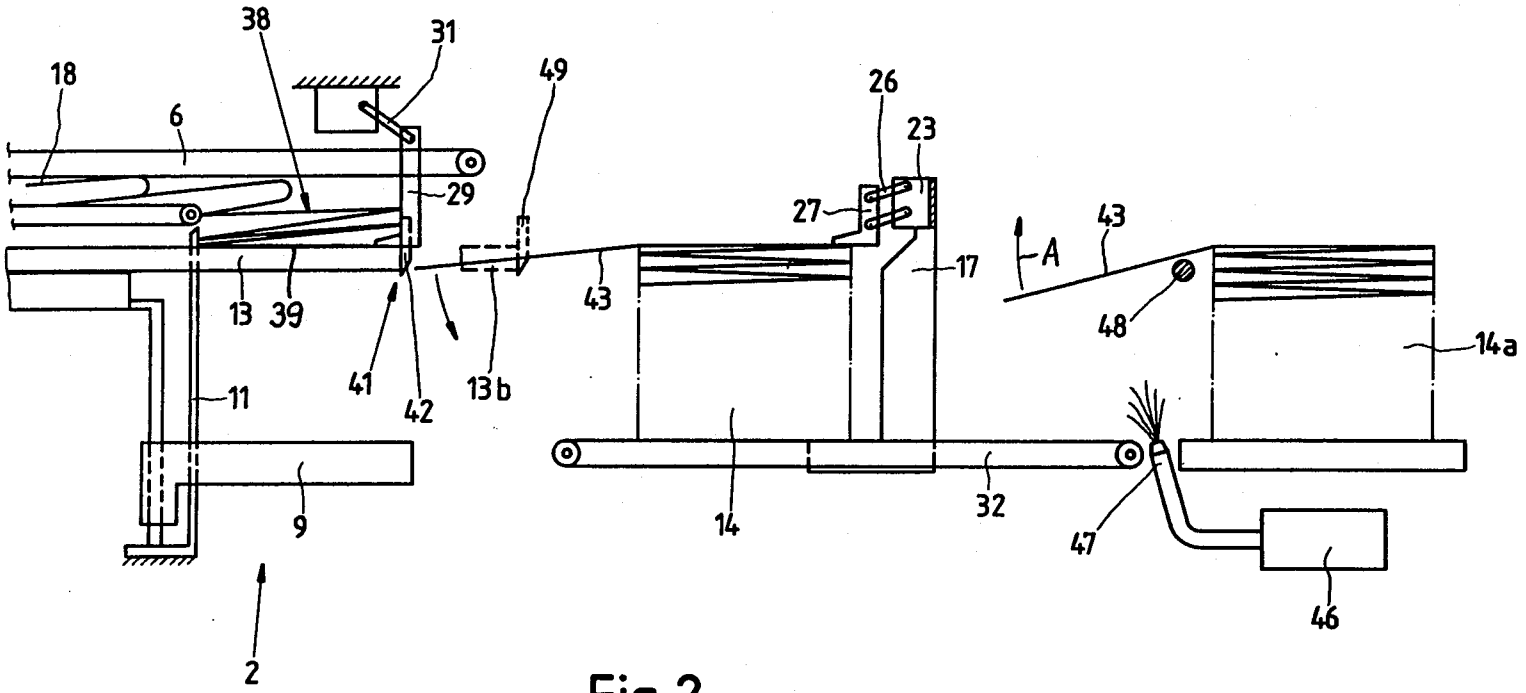
FIG. 2 shows the structure of FIG. 1 but with the freshly formed stack on its way from the stack forming to the evacuating station.
Figure 3:
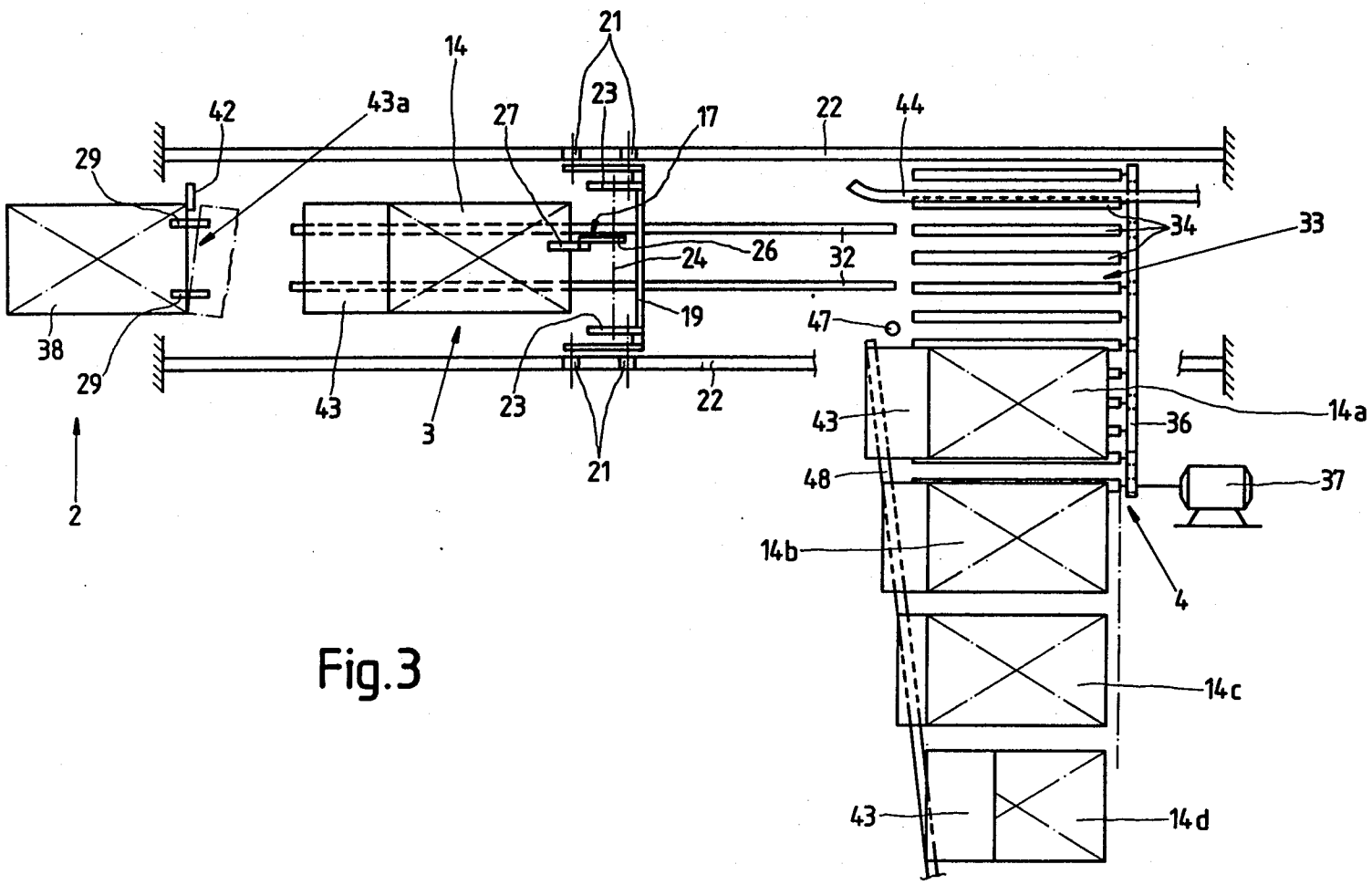
FIG. 3 is a plan view of the apparatus which is shown in FIGS. 1 and 2.

FIGS. 1 to 3 show a first apparatus which is designed to convert a continuously running web 18 into a succession of fully grown stacks 14, 14*a*, 14*b*, 14*c*, 14*d* . . . of overlapping or superimposed panels or sheets made of paper, metallic foil, plastic foil or other foldable strip material. The apparatus comprises a folding unit 1, a stacking or stack forming station 2, a conveyor arrangement 3 defining an elongated horizontal path for successive fully grown stacks 14–14*d*, and a removing or take-off unit 4 for fully grown stacks at an evacuating station.

The folding unit 1 comprises a first or upper endless belt conveyor 6 and a second or lower endless belt conveyor 7 defining with the conveyor 6 an elongated channel wherein successive increments of the running web 18 are converted into loops 8 each having an upper sheet or panel 8*a* and a lower sheet or panel 8*b*. The speed of the upper belt conveyor 6 exceeds the speed of the lower belt conveyor 7; this results in the making of the just mentioned loops 8 with panels or sheets 8*a*, 8*b* not later than upon arrival of such loops at the stacking station 2. Reference may be had to commonly owned copending patent application Ser. No. 881,193 filed July 2, 1986 by Besemann for "Method and apparatus for zig-zag folding webs of paper and the like", now U.S. Pat. No. 4,708,332 granted Nov. 24, 1987. The apparatus which is disclosed in the application Ser. No. 881,193 constitutes but one form of means for converting a continuously running web of paper or the like into a succession of stacks wherein the panels or sheets are folded over each other in zig-zag formation. For example, the means for forming a pile of superimposed panels or sheets in zig-zag formation can be of the type disclosed in commonly owned U.S. patent application Ser. No. 883,625 filed July 9, 1986 by Kwasnitza for "Apparatus for zig-zag folding of paper webs and the like", now U.S. Pat. No. 4,702,135 granted Oct. 27, 1987. The disclosures of these copending patent applications are incorporated herein by reference.

The stacking station 2 accommodates a stacking or locating table 9 which serves to support the foremost or lowermost sheet or panel 143 of a growing stack of panels which are caused to overlap each other in zig-zag formation. The table 9 is mounted on a vertical guide 9*a* and is movable up and down so as to descend during conversion of the leader of the web 18 into a succession of panels at the rate at which the stack 14 grows at the station 2. The guide 9*a* is mounted in or forms part of the frame F of the improved apparatus. The frame F further supports an upright stop 11 which is adjacent the guide 9*a* and ensures that the left-hand junctions or fold lines between neighboring panels of the stack 14 are disposed exactly on top of each other. The stop 11 can comprise a single vertical plate or it can be composed of two or more vertical strips which determine the extent to which the left-hand junctions or fold lines between neighboring panels of the stack 14 can move toward the vertical guide 9*a*. Still further, the frame F supports a stationary horizontal guide 12 for a reciprocable horizontal auxiliary table 13 which is movable in directions indicated by a double-headed arrow 13*a*, namely in parallelism with the direction of forward movement of the web 18 in the channel between the belt conveyors 6 and 7, and constitutes one member of a supporting means for a growing or second stack 38 of panels which accumulates on top of the stack 14 when the latter is fully grown so that it comprises a predetermined number of overlapping or superimposed panels including a foremost or lowermost panel 143 and a topmost or rearmost panel 43.

FIG. 1 shows substantial clearances between neighboring panels of the stacks 14 and 38. In actual practice, the width of such clearances is zero or close to zero so that the panels of the stacks 14 and 38 are in full or substantially full surface-to-surface contact with each other. The arrangement is preferably such that the neighboring panels in each of the stacks 14 and 38 are disposed in immediately adjacent parallel horizontal planes, i.e., the lowermost or foremost panel 39 of the stack 38 is immediately adjacent to and abuts the topmost or rearmost panel 43 of the lower stack 14. When the station 2 accommodates a growing stack 38, the stack 14 below such growing stack is already fully grown and is ready for evacuation from the stacking station 2 as well as for separation from the growing stack 38.

The means 16 for evacuating successive fully grown stacks 14*d*, 14*c*, 14*b*, 14*a*, 14 from the station 2 comprises tongs 17 which are reciprocable in directions indicated by a double-headed arrow 17*a*, namely in parallelism with the direction of advancement of the web 18 in the channel between the belt conveyors 6 and 7 of the folding unit 1.

As can be seen in FIG. 3, the tongs 17 are mounted on a transversely extending carrier 19 in the form of a horizontal crossbeam the end portions of which are provided with roller followers 21 arranged to travel along stationary guide rails 22 flanking the path which is defined by the conveyor arrangement 3. The carrier 19 supports two bearing plates 23 for a pair of horizontal shafts 24 (one indicated in FIG. 3 by a phantom line) supporting links 26 for upper engaging or gripping members 27 in the form of jaws forming part of the tongs 17 and movable into engagement with the topmost or next-to-the-topmost panel of a fully grown stack 14 (see particularly FIG. 2). The tongs 17 further comprise a lower jaw or engaging member 28 which is fixedly connected to the main body portion of the evacuating device 16. The evacuating device 16 including the tongs 17 is reciprocable in directions indicated by the arrow 17*a* in any conventional manner, for example by means similar to or identical with those disclosed in commonly owned U.S. Pat. No. 4,297,066 granted October 27, 1981 to Ramcke et al. The disclosure of this patent is incorporated herein by reference. It suffices to say that the evacuating device 16 is movable at required intervals in and counter to the direction of advancement of the web 18 so as to evacuate a fully grown stack 14 from the stacking station 2 and to thereupon return to a position of readiness adjacent the station 2 preparatory to engagement with the topmost panel 43 (or the panel below such topmost panel) and the lowermost panel 143 of the next fully grown stack 14 (i.e., with the corresponding panels of the converted or fully grown stack 38).

The aforementioned supporting means for successive growing stacks 38, which includes the auxiliary table 13 and the means for moving such table in directions indicated by arrow 13*a*, further comprises a substantially hook-shaped supporting member 29 which is movable up and down as well as into and out of the stacking station 2 so as to cooperate with the auxiliary table 13 (when the latter assumes the position of FIG. 2) to engage between them the lowermost panel 39 of the growing stack 38. The means for moving the supporting member 29 up and down as well as into and out of the stacking station 2 is shown schematically at 31. Such moving means can be identical with or analogous to the moving means which are disclosed in the aforementioned U.S. Pat. No. 4,297,066.

The transporting arrangement 3 comprises one or more endless belt conveyors 32 which may but need not be driven since they merely serve to support from below that fully grown stack which is engaged by the jaws 27, 28 of the tongs 17 while the tongs move from the stacking station 2 toward the removing unit 4.

The removing unit 4 comprises a transverse conveyor 33 which serves to transport successive fully grown stacks 14*d*, 14*c*, 14*b*, 14*a*, 14 in a direction at right angles to the direction of advancement of the web 18 between the conveyors 6 and 7. The transverse conveyor 33 can comprise a set of rollers 34 (see particularly FIG. 3) at least some of which can be rotated by a belt drive 36 which receives motion from a prime mover 37, for example, a variable-speed electric motor. The conveyor 34 can transport successive fully grown stacks to a packing station or to storage.

The mode of operation of the apparatus which is shown in FIGS. 1–3 is as follows:

The web 18 is continuously advanced by the conveyors 6 and 7 so as to form a succession of loops 8 each including an upper sheet or panel 8*a* and a lower sheet or panel 8*b*. The loops 8 are thereupon flattened at the stacking station 2 so as to form a pile of superimposed panels, and the pile ultimately grows sufficiently to form a fully grown stack such as the stack 14 shown in FIG. 1. The table 9 descends along the vertical guide 9*a* at the rate at which the stack 14 grows at the station 2. When the stack 14 is fully grown (namely when it contains a predetermined number of panels), the evacuating device 16 moves its tongs 17 in a direction to the left, as seen in FIG. 2 so that its jaws 27 and 28 respectively engage the next-to-the-uppermost and the lowermost panels of the fully grown stack 14. This position of the tongs 17 is shown in FIG. 1. In the next step, the moving means 31 lowers the hook-shaped supporting member 29 and causes its pallet to penetrate into the pile of superimposed panels of the web 18 at a level above the lowermost or foremost panel 39 of the growing stack 38 which is still connected to the fully grown stack 14 below it. In the next step, the tongs 17 are caused to move in a direction to the right so as to advance the fully grown stack 14 from the station 2 along the path which is defined by the transporting arrangement 3 and to the position which is shown in FIG. 2. At the same time, the auxiliary table or supporting member 13 is caused to move along its horizontal guide 12 in a direction to the right, as seen in FIG. 1, so that it advances to the position of FIG. 2 and is located at a level immediately below the lowermost or foremost panel 39 of the growing stack 38. At such time, the lowermost or foremost panel 39 of the growing stack 38 rests on the upper side of the auxiliary table 13 and the remaining or upper panels of the stack 38 rest on the pallet of the supporting member 29. This can be readily seen in FIG. 2.

The topmost or rearmost panel 43 of the fully grown stack 14 which is held by the tongs 17 is unfolded during movement from the position of FIG. 1 to the position of FIG. 2 because the upper jaw 27 of the tongs 17 engages the next-to-the-uppermost panel of the stack 14. This can be seen in FIG. 2. When the panel 43 is fully unfolded, a severing device 42 which is carried by the supporting member 29 descends to sever the web 18 in the region of the fold line 41 between the panel 43 and the panel 39, i.e., at a location which is spaced apart from the main part of the fully grown stack 14 on the conveyor 32 of the transporting arrangement 3. At such time, the auxiliary table or support member 13 already assumes its rightmost position which is shown in FIG. 2 so that its upper side fully supports the growing stack 38. The supporting member 29 can descend to the position of FIG. 2 at the time when the auxiliary table 13 already assumes the position of FIG. 2 so that the lowermost panel 39 of the growing stack 38 is severed from the unfolded panel 43 of the fully grown stack 14 at the time when the panel 39 is in full surface-to-surface contact with the upper side of the auxiliary table 13.

The knife of the severing device 42 can serve to sever the web 18 all the way along the preferably weakened fold line 41, i.e., all the way from one to the other marginal portion of the web 18. Alternatively, the knife of the severing device 42 can merely serve to destroy the integrity of one marginal portion of the web 18 in the region of the fold line 41 (which can comprise a row of perforations) so that breaking of the web 18 along the fold line 41 is actually accomplished by the evacuating device 16, namely by the tongs 17 as soon as the fully grown stack 14 is moved away from the stacking station 2 through a distance which exceeds the length of the unfolded panel 43 (as seen in the longitudinal direction of the web 18). In other words, the knife of the severing device 42 merely serves to make a small cut or tear in one marginal portion of the web 18 at the predetermined location where the web is to be broken between the stacks 14 and 38, and the remainder of the breaking or separating action is carried out by the tongs 17. The knife of the severing device 42 need not have a sharp cutting edge, i.e., such edge can be dull or reasonably dull, because it necessitates the exertion of a relatively small force to destroy the integrity of one end of the fold line 41 which is already weakened by a row of perforations or in any other suitable way.

FIG. 3 shows that the second supporting member of the means for supporting the growing stack 38 preparatory to and during removal of a fully grown stack (such as 14) from the station 2 can comprise two hooks 29 which engage spaced-apart portions of the lowermost panel 39 of the growing stack 38 at the station 2 during withdrawal of the fully grown stack 14. As mentioned above, the purpose of the supporting member or members 29 is to press the respective marginal portion of the panel 39 against the upper side of the auxiliary table 13 while such table assumes the position of FIG. 2 so as to ensure that the panel 39 cannot be pulled with the adjacent topmost or rearmost panel 43 of the stack 14 which is being engaged and advanced by the tongs 17 of the evacuating device 16.

FIG. 3 further shows that the jaws 27, 28 of the tongs 17 engage the respective panels of the fully grown stack 14 off center (namely closer to one than to the other lateral side or surface of such stack) so as to ensure that the stack 14 tends to turn and actually turns relative to the stack 38 during removal from the station 2. This is indicated (somewhat exaggerated) at **43*a* in the left-hand portion of FIG. 3. Such eccentric advancement of the stack 14 from the station 2 entails a tearing of the web 18 along the weakened fold line 41 in a direction from one toward the other marginal portion of the web. In other words, the knife of the severing device 42 can merely serve to destroy the integrity of the upper marginal portion of the web 18 (as seen in FIG. 3), and the remainder of the breaking action is carried out by the tongs 17 which pulls the stack 14 eccentrically so as to ensure that the break or tear in the web propagates itself in a direction from the marginal portion which is severed or broken by the knife of the severing device 42 toward the other marginal portion. The extent to which the stack 14 is being turned relative to the growing stack 38 at the station 2 while the tongs 17 move toward the removing device 4 can be very small, as long as it suffices to overcome the resistance of the web to breaking along the fold line 41 in a predetermined direction, namely from the marginal portion which is severed or broken by the knife of the severing device 42** toward the other marginal portion.

As the stack 14 continues to advance with the tongs 17 in a direction away from the stacking station 2, such stack is engaged by a reorienting rail 44 having a suitably curved front portion (see FIG. 3) which serves to reorient the stack 14 so that its lateral surfaces are again exactly parallel with the direction of forward movement of the web 18 and with the axes of rollers 34 forming part of the transverse conveyor 33 at the removing or take-off station. It is clear that the rollers 34 can be replaced with other types of transporting elements for successive fully grown stacks, such as by sets of endless belts, chains or the like. Furthermore, it is not necessary to invariably advance fully grown stacks at right angles to the direction of forward movement of the web 18. The exact direction of advancement by the conveyor 33 depends upon the location of the next treating or processing station for fully grown stacks.

Referring again to FIG. 2, the topmost panel 43 of the stack 14 which is held and advanced by the tongs 17 tends to pivot downwardly along the left-hand (trailing) side of the stack 14 on the conveyor or conveyors 32. In order to ensure that the panel 43 will overlie the next-highest panel of the stack 14, the apparatus further comprises means for refolding the panel 43 on its way toward and/or with the conveyor 33. The refolding means of the apparatus which is shown in FIGS. 1–3 comprises one or more nozzles 47 which are connected to a source 46 of compressed air or another suitable gaseous fluid and discharge jets of compressed gas against the underside of the unfolded panel 43 so that the panel 43 pivots upwardly in the direction indicated by arrow A and advances with the conveyor 33 along the upper side of a suitably configurated guide element 48 which completes the refolding operation by causing the panel 43 to gradually turn clockwise as seen in FIG. 2 and to ultimately come to rest on the nearest (next-to-the-topmost) panel of the stack 14 on the rollers 34 of the transverse conveyor 33. The illustrated refolding means 46–48 can be replaced by or used jointly with other types of refolding means without departing from the spirit of the invention. For example, the refolding means can comprise several sets of nozzles 47 which gradually pivot the panel 43 from the position shown in FIG. 2 to and beyond the position shown for the panel 43 of the stack **14*d* in the lower right-hand corner of FIG. 3**.

Figure 4:
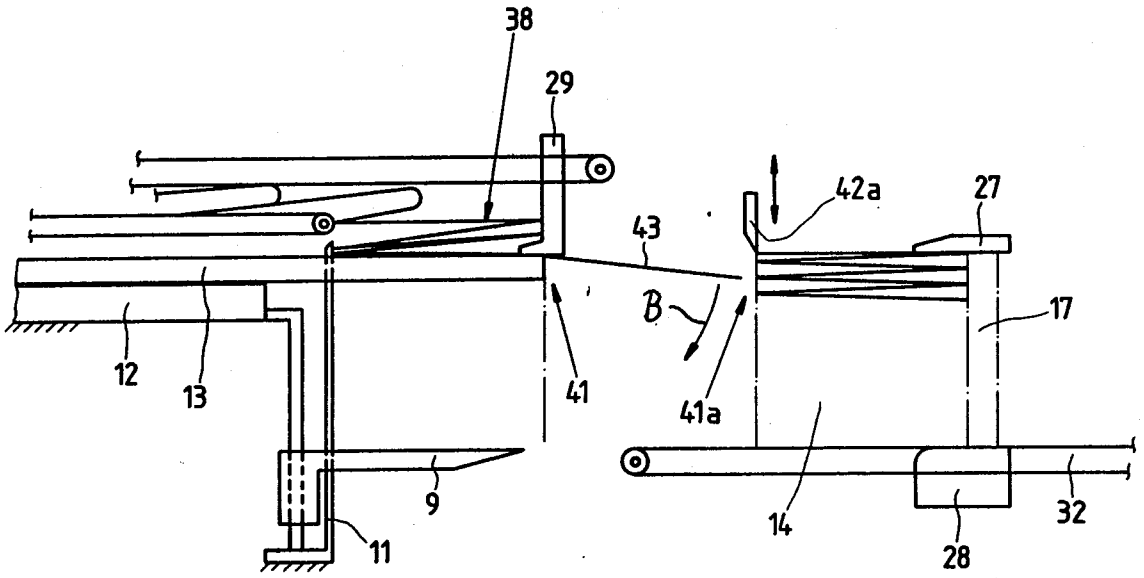
FIG. 4 is a fragmentary schematic elevational view of a modified apparatus.

FIG. 4 shows a portion of a modified apparatus with its parts in positions corresponding to those of the parts of the apparatus shown in FIG. 2. The parts of the second apparatus are denoted by reference characters corresponding to those used in FIGS. 1–3. The difference is that the panel 43 is to constitute the lowermost or foremost panel of the growing stack 38. Therefore, a severing device **42*a* is provided adjacent the path of movement of the fully grown stack 14 with the tongs 17 so as to sever the panel 43 from the stack 14 along a fold line 41*a* which connected such panel to the topmost panel of the stack 14. The panel 43 thereupon exhibits a tendency to pivot clockwise as indicated by the arrow B and must be folded beneath the next panel of the growing stack 38. This is accomplished by the lower jaw 28 of the tongs 17 at the time the tongs returns from the position of FIG. 4 to the position of FIG. 5 in which the tongs 17 are ready to engage the topmost and lowermost panels of the stack 38 which has fully grown in the meantime and is ready to be advanced toward and along the path which is defined by the conveyor or conveyors 32. The knife of the severing device 42*a* can again serve only as a means for destroying the integrity of one marginal portion of the web along the fold line 41*a*, and the actual tearing of the web all the way from the one marginal portion toward and to the other marginal portion can be affected again by the tongs 17, either by simply pulling the stack 14 in a direction to the right or by pulling and simultaneously changing the orientation of the stack 14** as a result of turning about a substantially vertical axis.

Figure 5:
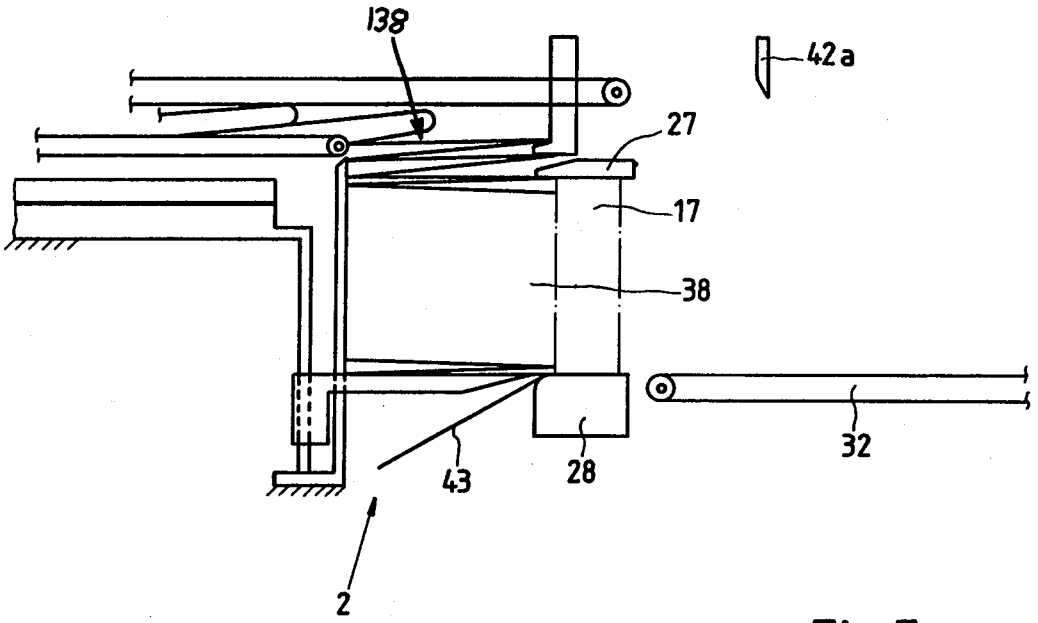
FIG. 5 shows the structure of FIG. 4 but with the stack transporting device at the stack forming station.

The reference character 138 denotes in FIG. 5 a further stack which is in the process of growing above the fully grown stack 38.

Referring again to FIG. 2, there is shown a further severing device 4 which is indicated by broken lines and is designed to sever the web 18 all the way across between its marginal portions and not necessarily along a weakened fold line. As shown, the severing device 49 can be positioned in such a way that it cuts across the panel 43 between the two ends of such panel. The auxiliary table is then preferably movable all the way to the position **13*b* which is shown in FIG. 2 by broken lines so as to ensure that the rightmost portion of the table 13*b* can serve as a counterknife which cooperates with the knife of the severing device 49 to cut across a selected portion of the panel 43. In fact, the arrangement may be such that the table 13 is sufficiently long to advance all the way to the rear or trailing side of the stack 14 shown in FIG. 2, and the severing device 49 is then located in the region of the weakened fold line which connects the panel 43 to the adjacent panel of the stack 14**.

The apparatus which are shown in FIGS. 1–3 and 4–5 each comprise a single stacking station 2, a single transporting arrangement 3, single tongs 17, and a single removing unit 4. However, it is equally possible to simultaneously form and manipulate two or more stacks at discrete stacking stations and to employ at least one discrete evacuating device (tongs) for each such station. This would merely amount to a multiplication of the parts which are shown in FIG. 3.

If the evacuating means 16 comprises several (e.g., two) tongs 17 which engage the front side of a fully grown stack side by side, the orientation changing step for each fully grown stack can be carried out in a simple and efficient way by moving one of the tongs faster than the other tongs or by temporarily arresting one of the tongs while the other tongs continue to advance the respective portion of the fully grown stack away from the stacking station 2. This also results in a turning of the fully grown stack about a substantially vertical axis. It suffices to temporarily introduce an obstruction into the path of movement of one of the tongs while the remaining tongs can continue to advance along the path which is defined by the conveyor arrangement 3 to thus ensure that the web 18 will begin to tear or break starting at one marginal portion and progressing toward the other marginal portion.

An important advantage of the improved apparatus is its compactness as well as its simplicity and reliability. The web 18 can be converted into a pile of superimposed panels in zig-zag formation in a folding unit that has been found to be highly satisfactory for such purposes, and severing or breaking of the web 18 in a selected region between successively formed fully grown stacks and the respective next-following (growing) stacks can be carried out with a high degree of accuracy and reproducibility. This ensures that (unless the severing device 49 of FIG. 2 is utilized) each and every panel of the folded web 18 can be utilized as a component part of one of the successively formed stacks. As described above, it is not even necessary to actually sever the web 18 because the web can break or tear along a selected fold line as a result of exertion of a simple forward pull or as a result of a forward pull plus a turning of the fully grown stack relative to the next-following (growing) stack or, if desired, as a result of slight severing or breaking along one marginal portion of the web so as to facilitate propagation of the break toward and all the way to the other marginal portion.

A further important advantage of the improved method and apparatus is that severing of the web 18 takes up little time or no extra time at all, even if the web is to be severed by the device 49, so that zig-zag folding of the web 18 need not be slowed down for the sole purpose of ensuring that the web will be broken or severed at selected locations between successive stacks. As a rule, the breaking or tearing of the web takes place subsequent to removal of the freshly grown stack from the stacking station 2 so that the severing operation cannot interfere with the folding and stacking operations which are the most sensitive steps of the method.

It is clear that the improved method and apparatus can be modified in a number of additional ways. For example, the stacking station 2 can accumulate two or more fully grown stacks before the lowermost fully grown stack is evacuated by the tongs 17 or by other suitable evacuating means. In other words, it is not necessary to invariably remove a fully grown stack from a growing stack but it is also within the purview of the invention to separate a fully grown preceding stack from a next-following fully grown stack. Moreover, the apparatus can be readily converted for the treatment of webs having different widths, stiffnesses and/or other characteristics. Still further, it is possible to increase or reduce the size of the panels which are formed at the stacking station 2 in any conventional manner.

While it is also possible to sever the fully grown stack from the next-following stack at the stacking station 2, breaking or severing of the web outside of the stacking station is preferred at this time for the aforediscussed reasons, namely because this greatly reduces the likelihood that the severing operation could interfere with the sensitive folding and stacking operations which take place at the station 2 and which could be more readily affected by the severing operation if the latter were to be carried out at the station 2. The feature that the topmost panel of the fully grown stack and/or the lowermost panel of the growing stack is unfolded during movement of the fully grown stack from the station 2 renders it possible to carry out the web breaking or tearing operation at a location which is remote from the station 2 as well as to provide ample time for breaking or tearing of the web without any slowing down of the folding, stacking and stack removing operations. Severing or separation along a fold line which is weakened is preferred in many instances because this reduces the likelihood of making unpredictable cuts or breaks across the web 18. It is presently preferred to separate a fully grown stack from the next following stack by tearing it along a weakened fold line as a result of exertion of a pull simultaneously with at least some turning of the fully grown stack about a substantially vertical axis as shown at **43*a* in FIG. 3. This renders it possible to utilize an evacuating device (16) which simultaneously performs the function of or includes the severing or breaking means. The provision of severing device 42 or 42*a* contributes still further to predictability of the breaking or severing action upon the web 18. The evacuating device 16 need not necessarily serve as a means or need not necessarily include a device, for severing, or breaking the web 18. However the illustrated arrangement is preferred at this time because it contributes to simplicity and compactness of the apparatus. Breaking of the web along a weakened fold line is preferred at this time because this renders it possible to break the web without resorting to severing instrumentalities which must be placed adjacent a predetermined portion of the path of movement of the web portion between two successive stacks and whose operation must be accurately synchronized with the speed of the evacuating device 16. Thus, all that is necessary is to ensure that the tongs 17 engage the freshly formed fully grown stack somewhat off center so that the stack is turned about a substantially vertical axis and thereby causes the web to break along a selected weakened fold line. Holding of the lowermost panel of the growing stack at the station 2 during tearing or breaking of the web along a selected weakened fold line contributes to predictable breaking of the web along such selected fold line. Moreover, the severing operation is completed at a rate which is determined solely by the speed of forward movement of the tongs 17. The supporting means 13, 29 ensure that the configuration and/or orientation of the growing stack at the station 2 is not affected by the breaking or severing operation which takes place between such growing stack and the preceding (fully grown) stack. The provision of aforedescribed supporting means including the table 13 and the supporting member 29** has been found to be particularly advantageous and desirable due to its simplicity and reliability.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of separating a fully grown first stack of overlapping panels which are folded over each other in zig-zag formation from a growing second stack which is being formed by zig-zag folding a continuous web of paper or the like and has a foremost panel integral with a rearmost panel of the first stack, comprising the steps of advancing the web longitudinally in a predetermined direction to a stacking station wherein the second stack is located at a level above the first stack so that the foremost panel is the lowermost panel of the second stack and the rearmost panel is the topmost panel of the first stack; breaking the web in the region of one of the foremost and rearmost panels; and removing the first stack from the stacking station in the course of said breaking step, including unfolding the rearmost panel of the first stack.

2. The method of claim 1 of separating a fully grown first stack from a growing second stack which is being formed by zig-zag folding a continuous longitudinally running web of paper or the like which has transversely extending weakened portions joining neighboring panels of the stacks to each other, wherein said breaking step includes destroying the integrity of the web along one of said weakened portions.

3. The method of claim 1, wherein said breaking step includes severing the web.

4. The method of claim 1, wherein said breaking step includes tearing the web.

5. The method of claim 1, further comprising the step of destroying the integrity of at least one marginal portion of the web in said region prior to said breaking step so as to facilitate breaking of the web.

6. The method of claim 5, wherein said destroying step includes making a cut in the one marginal portion of the web.

7. The method of claim 5, wherein said destroying step includes tearing the one marginal portion of the web.

8. Apparatus for separating a fully grown first stack of overlapping panels which are folded over each other in zig-zag formation at a stacking station from a growing second stack which is being formed at the stacking station by zig-zag folding a continuous longitudinally advancing web of paper or the like and has a foremost panel integral with a rearmost panel of the first stack, comprising means for locating the first stack at the stacking station beneath the second stack so that the foremost panel of the second stack is disposed above the rearmost panel of the first stack; means for supporting the second stack at said station including a supporting member and means for moving the supporting member between the foremost panel of the second stack and the rearmost panel of the first stack at said station; means for breaking the web in the region of one of the foremost and rearmost panels; and means for evacuating the first stack from said station prior to or during breaking of the web between the first and second stacks.

9. The apparatus of claim 8, wherein said evacuating means includes means for moving the first stack along a predetermined path, said breaking means including means for severing the web in a predetermined portion of said path.

10. The apparatus of claim 8, wherein said supporting means comprises means for supporting the second stack during breaking of the web between the first and second stacks.

11. The apparatus of claim 10, wherein said supporting means further includes a second supporting member and means for moving said members into and from the stacking station so that one of the foremost and rearmost panels is held between said members during breaking of the web between the first and second stacks.

12. The apparatus of claim 10, wherein said supporting member comprises a table and means for moving said table to and from the stacking station so that the table is located beneath the foremost panel of the second stack while the table is disposed at the stacking station.

13. The apparatus of claim 12, wherein said supporting means further comprises a second supporting member and means for moving the second supporting member up and down toward and away from the table so that the foremost panel of the second stack is held between the table and the second supporting member when the latter is adjacent the table.

14. The apparatus of claim 8, wherein said evacuating means includes means for unfolding the rearmost panel of the first stack during evacuation of the first stack from said station.

15. The apparatus of claim 14, wherein said evacuating means includes means for transporting the first stack from the stacking station along a predetermined path and said breaking means is adjacent said path to break the web in the region of the unfolded rearmost panel of the first stack.

16. The apparatus of claim 8 for separating a fully grown first stack which has a foremost and a rearmost panel from a growing second stack which is being formed by zig-zag folding a web while the web advances in a predetermined direction, wherein said evacuating means comprises at least one tongs having portions engageable with the first stack in the regions of the foremost and rearmost panels of the first stack and means for moving said tongs substantially in and counter to said direction.

17. The apparatus of claim 8, wherein said evacuating means includes said breaking means.

18. The apparatus of claim 8, wherein the first stack has a foremost panel and said evacuating means includes tongs having portions engageable with the first stack in the regions of the foremost and rearmost panels of the first stack.

19. The apparatus of claim 8, wherein said evacuating means includes means for moving the first stack along a predetermined path, and further comprising means for destroying the integrity of at least one marginal portion of the web in a predetermined portion of said path preparatory to breaking of the web in a direction from said one marginal portion toward the other marginal portion of the web.

20. A method of separating a fully grown first stack of overlapping panels which are folded over each other in zig-zag formation from a growing second stack which is being formed by zig-zag folding a continuous web of paper or the like and has a foremost panel integral with a rearmost panel of the first stack, comprising the steps of advancing the web longitudinally in a predetermined direction to a stacking station wherein the second stack is located at a level above the first stack so that the foremost panel is the lowermost panel of the second stack and the rearmost panel is the topmost panel of the first stack; breaking the web in the region of one of the foremost and rearmost panels, including changing the orientation of one of the stacks relative to the other of the stacks with attendant tearing of the web from one toward the other marginal portion of the web; and removing the first stack from the stacking station in the course of said breaking step.

21. The method of claim 20, wherein said orientation changing step includes turning the first stack about a substantially vertical axis.

22. A method of separating a fully grown first stack of overlapping panels which are folded over each other in zig-zag formation from a growing second stack which is being formed by zig-zag folding a continuous web of paper or the like and has a foremost panel integral with a rearmost panel of the first stack, comprising the steps of breaking the web in the region of one of the foremost and rearmost panels, including unfolding the foremost panel of the second stack and separating the unfolded foremost panel from the rearmost panel of the first stack; and refolding the foremost panel of the second stack.

23. A method of separating a fully grown first stack of overlapping panels which are folded over each other in zig-zag formation from a growing second stack which is being formed by zig-zag folding a continuous web of paper or the like and has a foremost panel integral with a rearmost panel of the first stack, comprising the steps of breaking the web in the region of one of the foremost and rearmost panels, including unfolding the rearmost panel of the first stack and separating the unfolded rearmost panel from the foremost panel of the second stack; and refolding the rearmost panel of the first stack.

24. Apparatus for separating a fully grown first stack of overlapping panels which are folded over each other in zig-zag formation at a stacking station from a growing second stack which is being formed at the stacking station by zig-zag folding a continuous longitudinally advancing web of paper or the like and has a foremost panel integral with a rearmost panel of the first stack, comprising means for breaking the web in the region of one of the foremost and rearmost panels, said breaking means including evacuating means having means for moving the first stack away from the stacking station in a direction to unfold one of the foremost and rearmost panels and through a distance which exceeds the length of the unfolded panel, as considered in the longitudinal direction of the web, so that the web breaks in the region of the unfolded panel.

25. Apparatus for separating a fully grown first stack of overlapping panels which are folded over each other in zig-zag formation at a stacking station from a growing second stack which is being formed at the stacking station by zig-zag folding continuous longitudinally advancing web of paper or the like and has a foremost panel integral with a rearmost panel of the first stack, comprising means for breaking the web in the region of one of the foremost and rearmost panels, said breaking means including means for changing the orientation of one of the stacks relative to the other stack so that the web tears in said region in a direction from one marginal portion toward the other marginal portion of the web.

26. The apparatus of claim 25, further comprising means for locating the first stack at the stacking station beneath the second stack and said orientation changing means includes means for turning the first stack relative to the second stack about a substantially vertical axis.

27. The apparatus of claim 26, wherein the first stack has a foremost panel and further comprising evacuating means having means for moving the first stack away from the stacking station along a predetermined path so as to unfold one of the foremost and rearmost panels, said moving means including a pair of tongs having portions engageable with the first stack in the regions of the foremost and rearmost panels of the first stack and means for moving said tongs along said predetermined path, said orientation changing means comprising means for changing the speed of movement of one of the tongs relative to the other of the tongs to thereby turn the first stack relative to the second stack.

28. Apparatus for separating a fully grown first stack of overlapping panels which are folded over each other in zig-zag formation at a stacking station from a growing second stack which is being formed at the stacking station by zig-zag folding a continuous longitudinally advancing web of paper or the like and has a foremost panel integral with a rearmost panel of the first stack, comprising means for breaking the web in the region of one of the foremost and rearmost panels; means for evacuating the first stack from the stacking station including means for unfolding the rearmost panel of the first stack prior to breaking of the web in said region; and means for refolding the rearmost panel of the first stack upon completed breaking of the web.

29. Apparatus for separating a fully grown first stack of overlapping panels which are folded over each other in zig-zag formation at a stacking station from a growing second stack which is being formed at the stacking station by zig-zag folding a continuous longitudinally advancing web of paper or the like and has a foremost panel integral with a rearmost panel of the first stack, comprising means for breaking the web in the region of one of the foremost and rearmost panels; means for evacuating the first stack from the stacking station including means for unfolding the rearmost panel of the second stack prior to breaking of the web in said region; and means for refolding the foremost panel of the second stack upon completed breaking of the web.

30. The apparatus of claim 29, wherein said refolding means forms part of said evacuating means.

* * * * *